US005238129A

United States Patent [19]

Ota

[11] Patent Number: 5,238,129

[45] Date of Patent: Aug. 24, 1993

[54] CONTAINER HAVING RIBS AND COLLAPSE PANELS

[75] Inventor: Akiho Ota, Chiba, Japan

[73] Assignee: Yoshino Kogyosho Co., Ltd., Tokyo, Japan

[21] Appl. No.: 892,664

[22] Filed: Jun. 3, 1992

Related U.S. Application Data

[63] Continuation of Ser. No. 690,387, Apr. 24, 1991, abandoned, which is a continuation of Ser. No. 570,969, Aug. 22, 1990, abandoned, which is a continuation of Ser. No. 760,547, Jul. 30, 1985, abandoned.

[51] Int. Cl.[5] ..... B65D 23/00

[52] U.S. Cl. ..... 215/1 C; 220/608

[58] Field of Search ..... D9/545, 556, 557, 563, D9/570, 569; 215/1 C; 220/608

[56] References Cited

U.S. PATENT DOCUMENTS

| | | | |
|---|---|---|---|
| D. 171,647 | 3/1954 | Hills . | |
| D. 240,968 | 8/1976 | Hurst | D9/407 X |
| D. 261,864 | 11/1981 | Abramo . | |
| D. 267,233 | 12/1982 | Aoki . | |
| D. 283,794 | 5/1986 | Richter | D9/396 |
| D. 294,120 | 2/1988 | Griesing et al. | D9/403 |
| D, 294,679 | 3/1988 | Griesing et al. | D9/401 |
| 3,225,950 | 12/1965 | Josephsen et al. | 215/1 C |
| 3,286,902 | 11/1966 | Hunter et al. | 220/72 X |
| 3,297,194 | 1/1967 | Schaper et al. | 220/72 |
| 3,397,724 | 8/1968 | Bolen et al. . | |
| 3,403,804 | 10/1968 | Colombo | D9/399 X |
| 3,536,223 | 10/1970 | Muhlhoff et al. | 215/1 C |
| 3,708,082 | 1/1973 | Platte . | |
| 3,722,725 | 3/1973 | Khetani et al. . | |
| 3,759,416 | 9/1973 | Constantine | 220/70 X |
| 3,926,341 | 12/1975 | Lhoest . | |
| 3,931,074 | 1/1976 | Gower | 215/1 C |
| 3,947,205 | 3/1976 | Edwards . | |
| 4,046,275 | 9/1977 | Virog, Jr. et al. | 215/1 C |
| 4,127,206 | 11/1978 | Virog, Jr. et al. | 215/1 C |
| 4,298,045 | 11/1981 | Weiler et al. . | |
| 4,318,882 | 3/1982 | Agrawal et al. . | |
| 4,320,083 | 3/1982 | Jakobsen . | |
| 4,379,099 | 4/1983 | Ota et al. . | |
| 4,387,816 | 6/1983 | Weekman | 215/1 C |

FOREIGN PATENT DOCUMENTS

| | | |
|---|---|---|
| 54-30654 | 2/1979 | Japan . |
| 57-126310 | 8/1982 | Japan . |
| 606383-4 | 11/1983 | Japan . |
| 5595444 | 12/1983 | Japan . |

OTHER PUBLICATIONS

"Gatorade Tests Bottle of Future" Packaging, Oct. 1987.

*Primary Examiner*—Bryon P. Gehman
*Attorney, Agent, or Firm*—Oliff & Berridge

[57] ABSTRACT

A hollow blow-molded container of a biaxially oriented thermoplastic material in which the container body section contains a rib strip and a rib groove below the collapse panels to accommodate evacuation of the container without deleterious changes in the appearance or strength of the container. The rib strip and rib groove below the collapse panels supports the container's body section during shrinkage of the contents of the container and reduces deformation during fabrication of the container.

23 Claims, 6 Drawing Sheets

FIG. 3
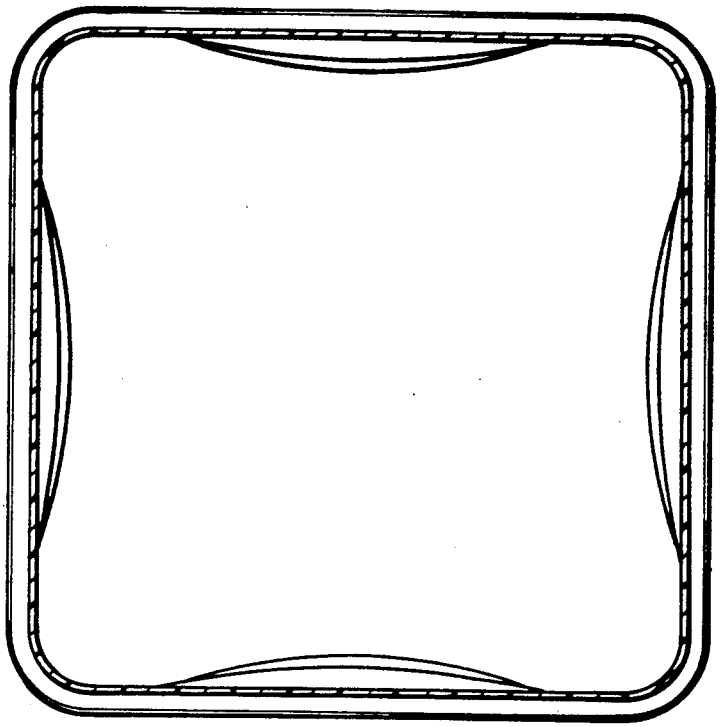
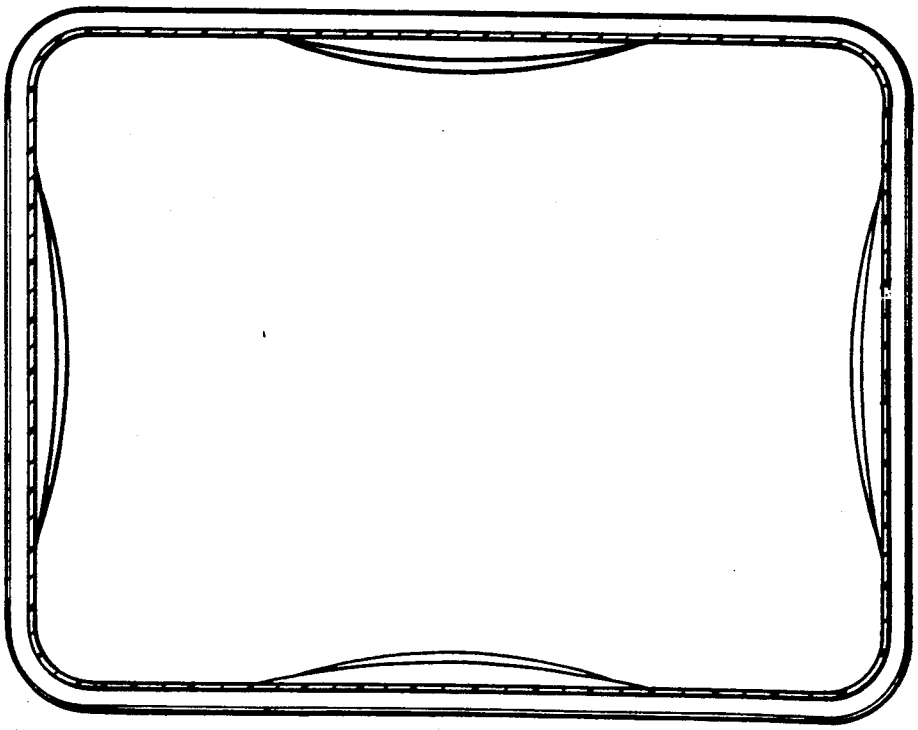
FIG. 4

CONTAINER HAVING RIBS AND COLLAPSE PANELS

This is a continuation of application Ser. No. 07/690,387 filed Apr. 24, 1991, now abandoned, which in turn is a continuation application of Ser. No. 07/570,969 filed Aug. 22, 1990 now abandoned which in turn is a continuation application of Ser. No. 06/760,547 filed Jul. 30, 1985 now abandoned.

BACKGROUND OF THE INVENTION

The present invention relates to hollow blow-molded containers of a biaxially oriented thermoplastic material, and more particularly to thin-walled plastic containers configured to accommodate partial evacuation without adverse effects on their appearance.

Lightweight, thin-walled containers made of thermoplastic materials such as polyester resin and thermoplastic polymers containing at least 50% by weight polymerized nitrile-group-containing monomer (hereinafter "nitriles") are well known in the container industry. For example, polyethylene terephthalate (PET) has a wide range of applications in the field of containers for foodstuffs, flavoring materials, cosmetics, beverages and so on. PET can be molded, by orientation-blowing, into transparent thin-walled containers having a high stiffness, impact strength and improved hygienic qualities with a high molding accuracy. Strong, transparent and substantially heat resistant containers may be produced by the biaxial-orientation blow-molding process in which a parison is oriented both laterally and longitudinally in a temperature range suitable for such orientation. Nitrile and heat-set PET containers are particularly heat resistant, and can be considered hot-fillable materials—i.e., container materials which may be filled with liquids at 65°-100° C., and more generally at 75°-95° C. Biaxially-oriented blow-molded containers have greater stiffness and strength as well as improved gas barrier properties and transparency.

When a thermoplastic container is hot-filled (such as with a liquid sterilized at a high temperature) and sealed, subsequent thermal contraction of the liquid upon cooling results in partial evacuation of the container which tends to deform the container walls. Backflow into a filling mechanism and the use of vacuum filling equipment during filling operations can similarly create a partial vacuum inside the container resulting in its deformation. Such deformation typically concentrates at the mechanically weaker portions of the container, resulting in an irregular and commercially unacceptable appearance. Further, if the deformation occurs in an area where the label is attached to the container, the appearance of the label may be adversely affected as a result of container deformation.

By increasing the wall thickness of the container, it is possible to some extent to strengthen the container walls and thus to decrease the effects of vacuum deformation. However, increasing the wall thickness results in a substantial increase in the amount of raw materials required to produce the container and a substantial decrease in production speed. The resultant increased costs are not acceptable to the container industry.

A prior attempt to reduce the effects of vacuum deformation is disclosed in U.S. Pat. No. 3,708,082 to Platte. Platte discloses a container with four flat wall-panels comprising the body portion of the container. A rib circumscribes the entire container in a region below the handle and serves to rigidify the side wall-portions in a circumferential direction. The rib also acts as a hinge to allow limited inward collapsing of the container along selected regions.

Another prior approach to reduction of the effects of vacuum deformation is disclosed in Japanese Application No. 54-30654. In this approach, a container is provided with a plurality of recessed collapse panels, separated by lands, which allow uniform controlled inward deformation so that vacuum effects are accommodated in a uniform manner without adverse effects on the appearance of the container.

U.S. Pat. No. 4,298,045 to Weiler et al shows another prior art approach in which a container has rigidifying grooves and embossments provided in the side walls of the container. Rather than controlling collapse, these rigidifying features substantially eliminate collapse, and are thus useful only with relatively low levels of evacuation.

While some prior art approaches have included the use of collapse panels (i.e., indented surface areas which provide for controlled, quantified collapse) to overcome thermal deformation, problems have developed in containers designed with large collapse panels. While large collapse panels accommodate a greater degree of controlled deformation, as the width of the collapse panel is increased the strength of the container body decreases. Additionally, the container is weakest just above and below the collapse panels since the body section support is lessened in those areas. Also, waviness tends to appear at the ends of wide collapse panels during fabrication, and even extends in some cases to the seating ring at the bottom end of the container. The present invention eliminates the aforementioned disadvantages.

SUMMARY OF THE INVENTION

The present invention relates to a hollow blow-molded container of basically-oriented thermoplastic material, wherein the container walls contain collapse panels, and below and preferably also above the collapse panels there are ribs to strengthen the container body, thereby accommodating evacuation of the container and facilitating its fabrication without deleterious changes in the container's strength or appearance. More specifically, a thin-walled plastic container of the present invention comprises a bottom section, a neck section, and a body section extending between the neck section and the bottom section, the body section including at least one collapse panel and, below and preferably also above the collapse panel(s), an annular rib strip and rib groove which circumscribe the body section.

The circumscribing the body section increase the strength of the container. In this way, large collapse panels can be utilized, thereby accommodating large evacuation effects by controlled, uniform vacuum deformation.

BRIEF DESCRIPTION OF THE DRAWINGS

FIG. 3 is a cross-sectional view of a cross-sectionally square container of the invention;

FIG. 4 is a cross-sectional view of a cross-sectionally rectangular container of the invention;

DETAILED DESCRIPTION OF PREFERRED EMBODIMENTS OF THE INVENTION

Figure 1:
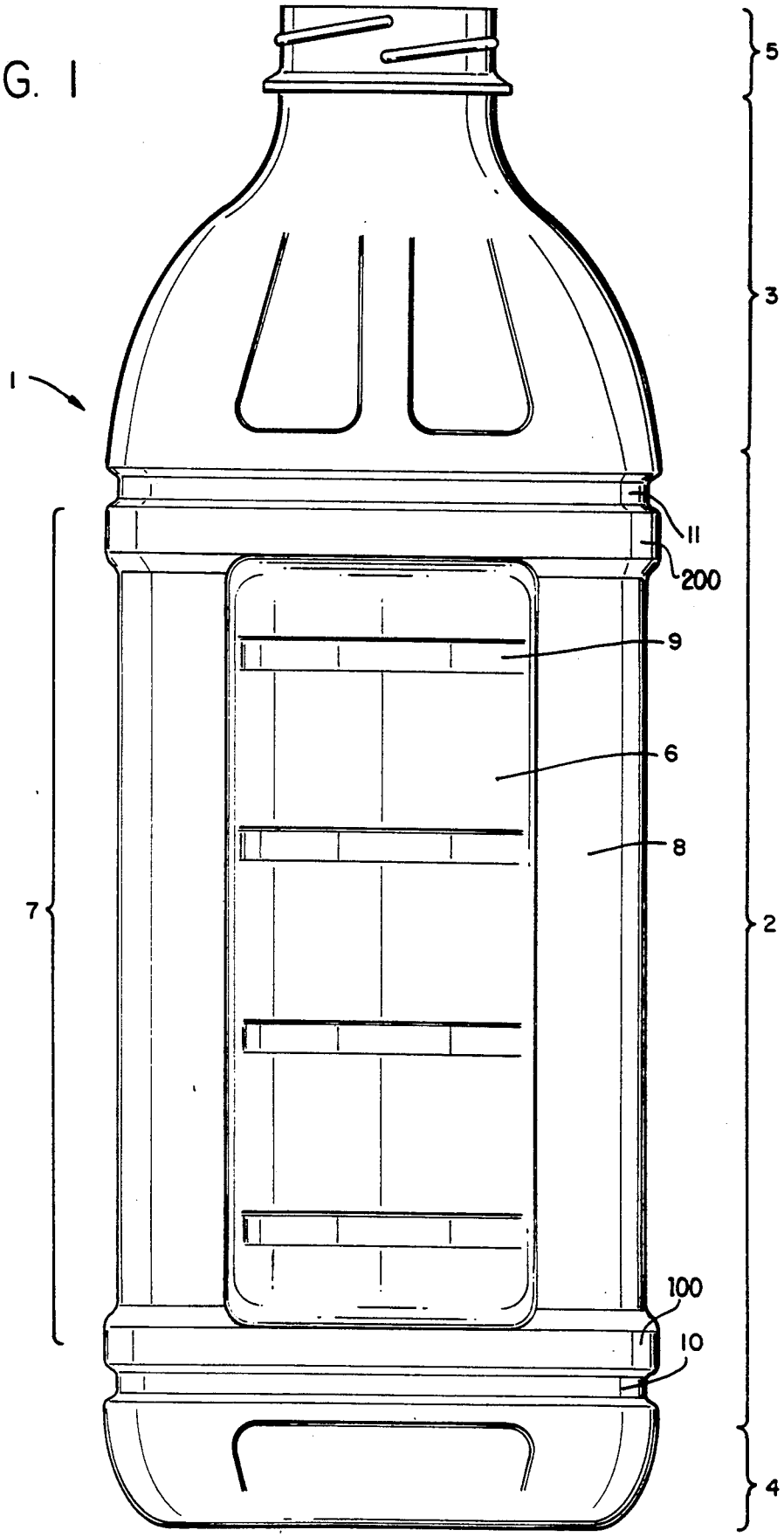
FIG. 1 is a side view of an embodiment of the present invention.
Figure 8:
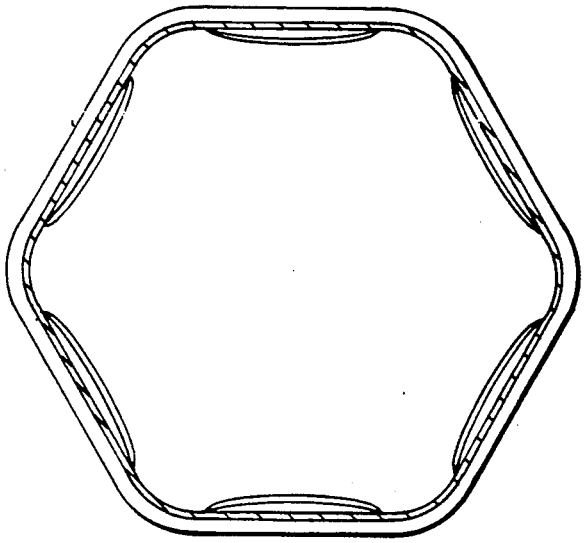
FIG. 8 is a cross-sectional view of a cross-sectionally hexagonal container of the invention.

Referring now to the drawings, FIG. 1 depicts a thin-walled blow-molded plastic container 1 which may be formed of polyethylene terephthalate (PET) or a nitrile. The container 1 comprises a body section 2 having a shoulder portion 3. The body section can be of any cross-sectional shape, for example, polygonal such as rectangular (FIG. 4), square (FIG. 3), hexagonal (FIG. 8) or octagonal (FIG. 9), or round, and is preferably rectangular or square. The lower end of the body section 2 is closed off by bottom section 4. The body section 2 extends upwardly from the bottom section 4 and tapers radially inwardly at the top of the body section to form the shoulder section 3 which terminates at a neck section 5. The neck section 5 may include external threads for a closure (not shown) and the neck section 5 may be crystallized to provide thermal, chemical and mechanical strength in the unstretched neck section as disclosed, for instance, in U.S. Pat. No. 4,379,099.

The body portion 2 of the container is specifically configured to accommodate controlled changes of the volume of the container upon its partial evacuation. As shown in FIG. 1, a longitudinally elongated indented collapse panel 6 is formed on at least one side of an axially extending collapse panel portion 7 which contains all of the collapse panels 6 in the body section 2. In a preferred embodiment, a generally rectangular or oval shaped collapse panel 6 is formed at each side of a polygonal body section 2, and adjacent collapse panels 6 are separated from each other by lands 8. The collapse panel portion preferably extends over substantially the entire axial length of the body section 2. The body portion 2 of the container depicted in FIG. 1 includes rib strip 100 and rib groove 10 below the collapse panel 6, and rib strip 200 and rib groove 11 above the collapse panel 6.

As the size of a collapse panel becomes larger, the strength of the container is lessened and therefore the ability to achieve a controlled and uniform collapse of the container becomes more difficult. That is, as the volume of the container and size of the collapse panel become larger, there is potentially a greater amount of deformation possible and therefore a greater likelihood of uneven deformation. Furthermore, fabrication difficulties are likely to lead to waviness in the container at the ends of the collapse panels. By including rib 10 below the collapse panel, collapse panels of greater widths and heights can be utilized, thereby allowing for greater controlled vacuum deformation of the container. The collapse panels from the bottom section of the container, and also compensate for unequal stretching near the bottom of square and rectangular containers. At the same time, the strength of the container body is increased.

Figure 2:
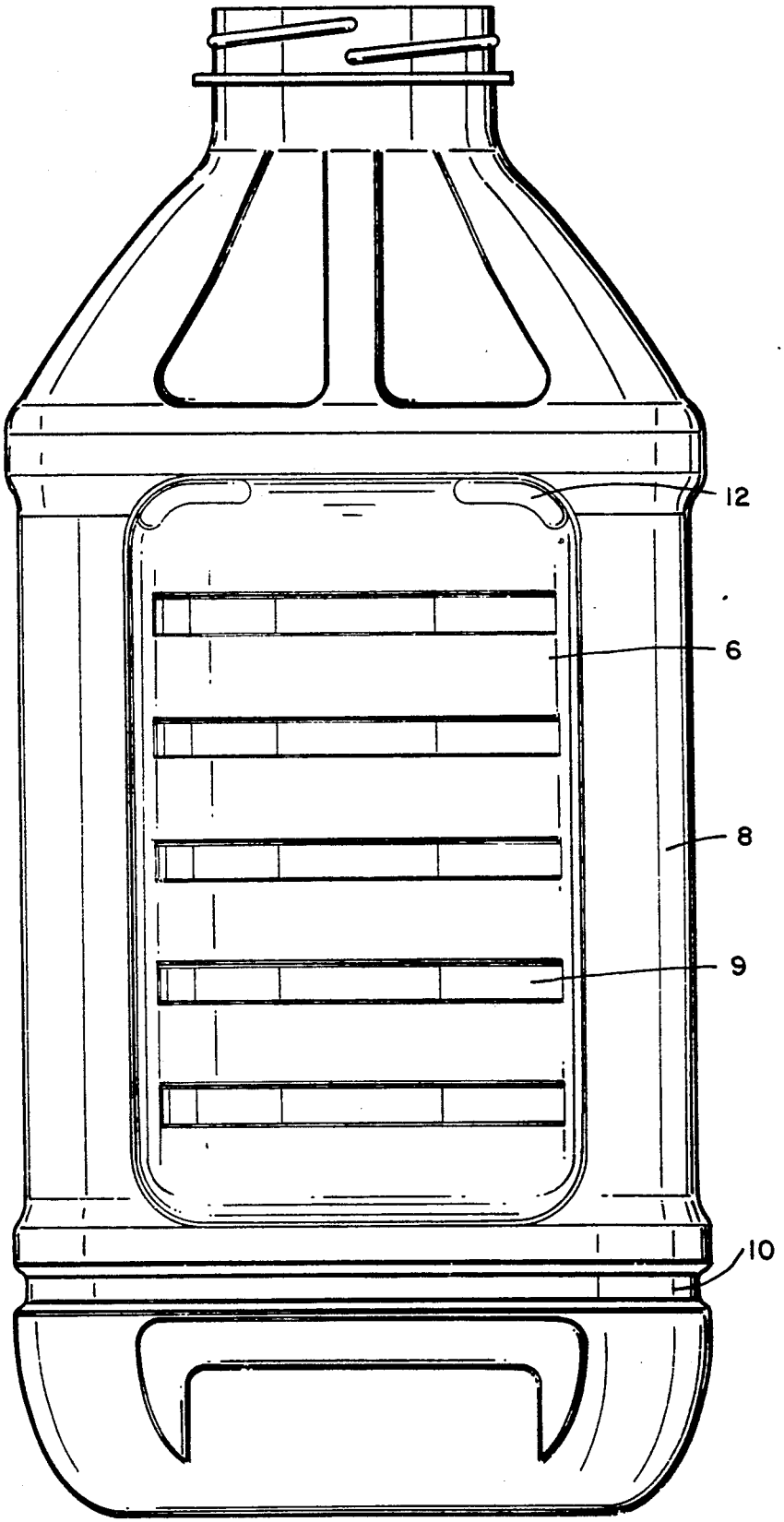
FIG. 2 is a side view of another embodiment of the present invention.
Figure 5:
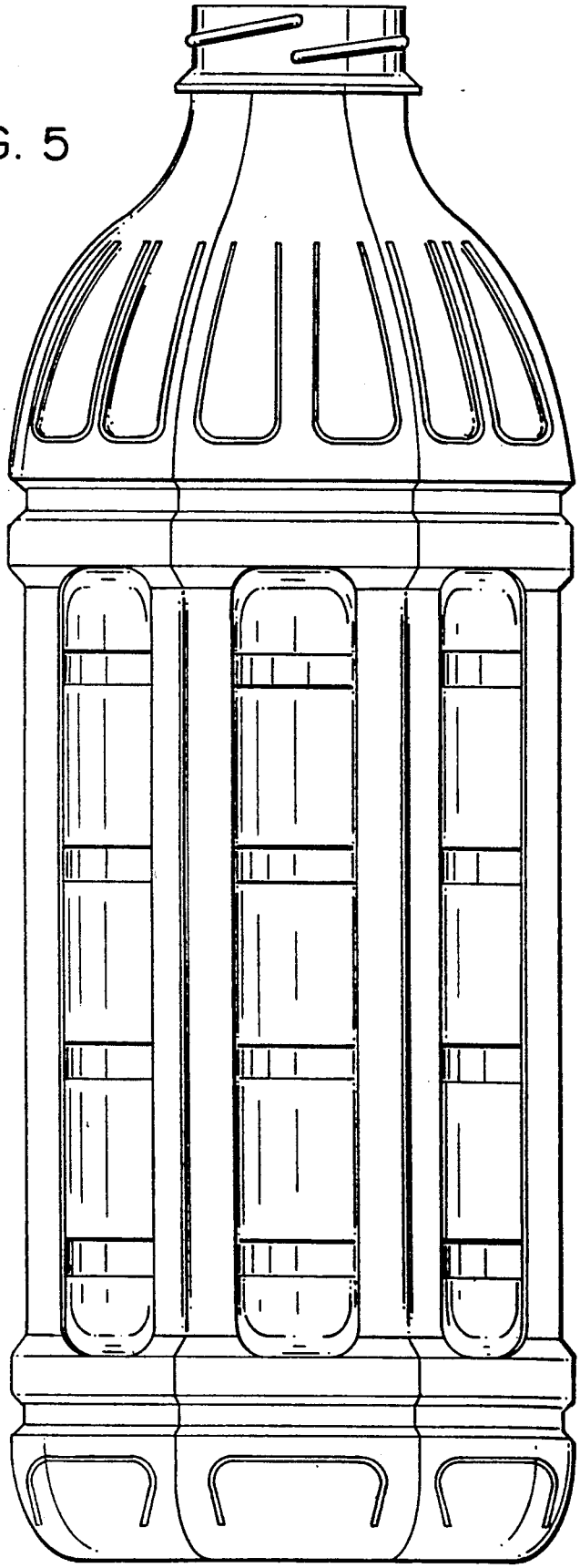
FIG. 5 is a side view of another embodiment of the present invention.
Figure 6:
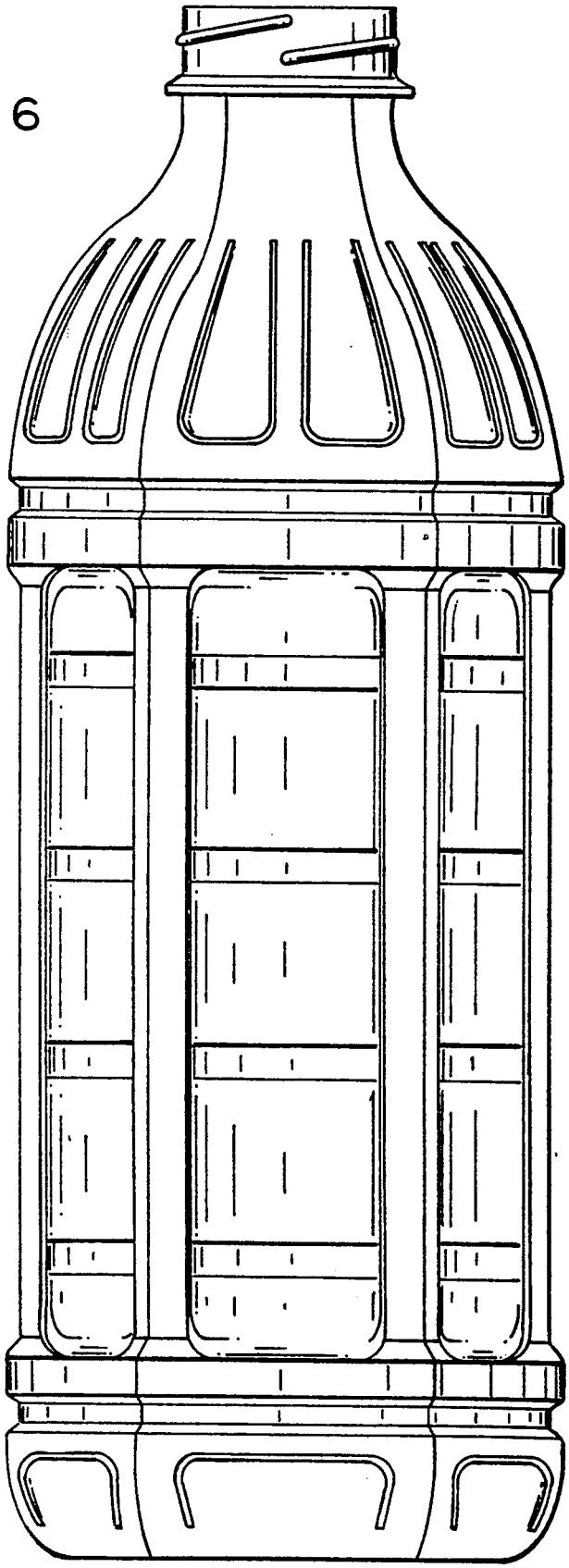
FIG. 6 is a side view of another embodiment of the present invention.
Figure 7:
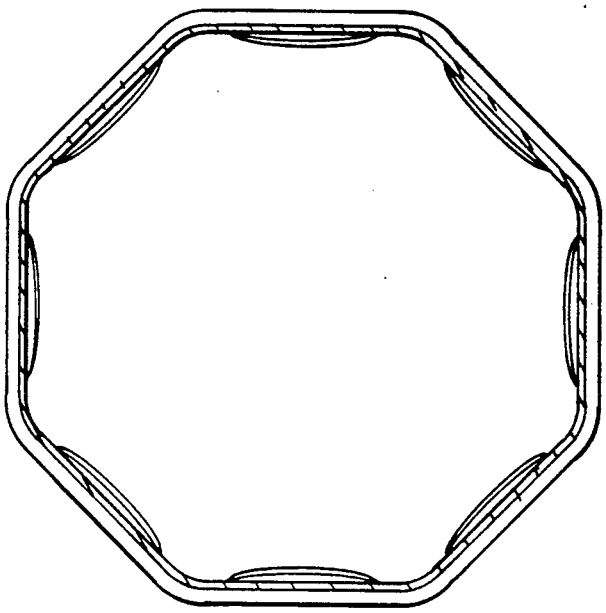
FIG. 7 is a cross-sectional view of a cross-sectionally octagonal container of the invention.

Further increases in container strength may be provided by way of additional support at the top of the collapse panel portion. This additional support takes the form of an upper rib 11 above and adjacent the top of the collapse panel portion. In this embodiment, the two ribs 10 and 11 isolate the collapse panels from the rest of the body section of the container, thus strengthening the portions of the container body which would otherwise by weakened by the proximity of collapse panels. The two ribs also assist in fabrication of square and rectangular containers by compensating for variations in degree of stretch at the susceptible portions of the container. In the alternative embodiment of FIG. 2, the additional support at the top of the collapse panel portion takes the form of inverted "L" shaped ribs 12 in the upper parts of at least one of the collapse panels.

An increase in the number of panels, whereby each panel has a smaller width, does not improve the ability of the container to compensate for internal vacuum nearly as much as does the use of larger width collapse panels. The support provided by the present invention allows for collapse panels of greater width and height. In a preferred embodiment, each collapse panel further contains one or more ribs 9 which serve to strengthen the collapse panels 6. The number of ribs per panel depends primarily on the height of the collapse panel, as well as the type and thickness of material forming the container. That is, different materials exhibit different degrees of resistance to deformation under vacuum and in the course of any heat setting, and the requisite number of ribs per collapse panel will change accordingly. Additionally, the conditions under which the container is filled and the nature of the contents to be filled into the container will affect the number of ribs required. The determination of the number of ribs per panel based on the type of material of the container, the contents of the container and the temperature of filling can be made by those of ordinary skill in the art upon routine experimentation.

The following examples will illustrate the invention, but are not intended to limit the scope of the patent as defined in the claims appended hereto.

EXAMPLES

A square cross-section container of 64 ounce size was made. The container had large collapse panels on all 4 sides. Upon hot filling and then cooling to room temperature a vacuum was created in the container. The panels collapsed as designed, but there was also some deformation both above and below the panels. Another container of the same design was made wherein ribs were added immediately above and below the collapse panels. When this container was hot-filled at the same temperature and then cooled down there was no deformation either above or below the collapse panels. Yet another container of the same original design was made wherein a rib was added immediately below the collapse panels, and inverted "L" shaped ribs were added in the upper parts of the collapse panels. Upon undergoing the same hot-filling and cooling steps, there was no deformation either above or below the collapse panels.

Various modifications and alterations of the present invention will be readily apparent to persons skilled in the art. It is intended, therefore, that the foregoing be considered as exemplary and that the scope of the invention be limited only by the following claims.

What is claimed is:

1. A thin-walled container made of thermoplastic material, comprising:

a bottom section;

a neck section;

a shoulder section; and a body section extending between said shoulder section and said bottom section, said body section having a cross-section substantially of a shape selected from the group consisting of square, rectangular, hexagonal and octagonal, said body section including an axially extending collapse panel portion circumscribing said body section, said collapse panel portion including at least one collapse panel and at least one adjacent land, an interior of said collapse panel portion having a first area defined by a first plane transverse to, passing through and circumscribed by said axially extending collapse panel portion, said at least one collapse panel providing controlled, quantified collapse upon exposure of an interior of said container to a partial vacuum; and a first annular rib strip and rib groove circumscribing said body section below and adjacent said collapse panel portion, wherein a second plane passing through and circumscribed by said first annular rib strip has a second area larger than said first area of said collapse panel portion.

2. The container of claim 1, wherein a second annular rib strip and rib groove circumscribes said body section above and adjacent sad collapse panel portion.

3. The container of claim 2, wherein the diameter of said second annular rib strip is equal to the largest diameter of the container.

4. The container of claim 1, wherein each said collapse panel includes at least one rib extending therein.

5. The container of claim 1, wherein said body section includes a collapse panel on each side of said body section.

6. The container of claim 1, wherein said body section includes a collapse panel on each of at least two opposite sides of said container.

7. The container of claim 1, wherein said collapse panel portion extends over substantially an entire axial length of said body section.

8. The container of claim 1, wherein said material is polyethylene terephthalate.

9. The container of claim 8, wherein said neck section is crystallized.

10. The container of claim 1, wherein said material is a nitrile.

11. The container of claim 1, wherein each said collapse panel extends over substantially an entire axial length of said collapse panel portion.

12. The container of claim 1, wherein the diameter of said first annular rib strip is equal to the largest diameter of the container.

13. The container of claim 1, wherein said rib groove has a third diameter smaller than said second diameter.

14. A thin-walled container made of thermoplastic material, said container comprising a bottom section, a neck section, a shoulder section and a body section extending between said bottom section and said shoulder section, said body section having a cross-section substantially of a shape selected from the group consisting of square, rectangular, hexagonal and octagonal, said body section including a collapse panel portion comprised of a plurality of longitudinally elongated collapse panels separated by adjacent lands, an interior of said collapse panel portion having a first area defined by a first plane passing transversely through and circumscribed by said collapse panel portion, said collapse panels providing controlled, quantified collapse upon exposure of an interior of said container to a partial vacuum, and a first annular rib strip and rib groove below and adjacent the bottoms of said collapse panels, wherein a second plane passing through and circumscribed by said annular rib strip has a second area larger than said first area and a third plane passing through and circumscribed by said rib groove has a third area smaller than said second area.

15. The container of claim 14, wherein a second annular rib strip and rib groove circumscribes said body section above and adjacent said collapse panels.

16. The container of claim 15, wherein the diameter of said second annular rib strip is equal to the largest diameter of the container.

17. The container of claim 14, wherein said material is a hot-fillable material selected from the group consisting of heat-set polyethylene terephthalate and a nitrile.

18. The container of claim 14, wherein the diameter of said first annular rib strip is equal to the largest diameter of the container.

19. A thin-walled container, said container comprising a hot-fillable thermoplastic material selected from the group consisting of heat-set polyethylene terephthalate and a nitrile;

said container comprising a bottom section, a neck section and a body section extending between said bottom section and said neck section, the top of said body section tapering radially inwardly to form a shoulder portion;

a mid-portion of said body section having a cross-section substantially of a shape selected from the group consisting of square and rectangular;

said body section including an axially extending collapse panel portion, circumscribing said body section, containing at least one longitudinally elongated collapse panel and a land adjacent thereto, said collapse panel providing controlled, quantified collapse upon exposure of an interior of said container to a partial vacuum, a first annular rib strip and rib groove between said collapse panel portion and said bottom section, and a second annular rib strip and rib groove between said collapse panel portion and said shoulder portion wherein said first annular rib strip and said second annular rib strip protrude outwardly from said land.

20. The container of claim 19, wherein a diameter of said first annular rib strip is equal to a diameter of said second annular rib strip and the largest diameter of the container.

21. A thin-walled container made of thermoplastic material, comprising:

a bottom section;

a neck section;

a shoulder section; and a body section extending between said shoulder section and said bottom section, said body section having a cross-section substantially of a shape selected from the group consisting of square, rectangular, hexagonal and octagonal, said body section including an axially extending collapse panel portion circumscribing said body section, said collapse panel portion including at least one collapse panel and at least one land adjacent thereto, an interior of said axially extending collapse panel portion having a first area defined by a first plane passing transversely through and circumscribed by said collapse panel portion, said at least one collapse panel providing controlled, quantified collapse upon exposure of an interior of said container to a partial vacuum; and an annular rib strip and rib groove circumscribing said body section above and adjacent said collapse panel portion, wherein a second plane passing through and circumscribed by said annular rib strip has a second area larger than said first area.

22. The container of claim 21, wherein the diameter of said first annular rib strip is equal to the largest diameter of the container.

23. The container of claim 21, wherein said rib groove has a third diameter smaller than said second diameter.

* * * * *